US011835280B2

(12) United States Patent
Derosier

(10) Patent No.: US 11,835,280 B2
(45) Date of Patent: Dec. 5, 2023

(54) EVAPORATOR LIQUID PREHEATER FOR REDUCING REFRIGERANT CHARGE

(71) Applicant: EVAPCO, INC., Taneytown, MD (US)

(72) Inventor: Greg Derosier, Eldersburg, MD (US)

(73) Assignee: EVAPCO, INC., Taneytown, MD (US)

( * ) Notice: Subject to any disclaimer, the term of this patent is extended or adjusted under 35 U.S.C. 154(b) by 0 days.

(21) Appl. No.: 16/181,754

(22) Filed: Nov. 6, 2018

(65) Prior Publication Data

US 2019/0154308 A1 May 23, 2019

Related U.S. Application Data

(62) Division of application No. 14/789,910, filed on Jul. 1, 2015, now Pat. No. 10,119,729.

(60) Provisional application No. 62/019,877, filed on Jul. 1, 2014.

(51) Int. Cl.

| | |
|---|---|
| ***F25B 5/04*** | (2006.01) |
| ***F25B 6/04*** | (2006.01) |
| ***F25B 40/00*** | (2006.01) |
| ***F25B 49/02*** | (2006.01) |
| ***F25B 39/02*** | (2006.01) |
| ***F25B 41/00*** | (2021.01) |
| *F25B 5/02* | (2006.01) |

(52) U.S. Cl.

CPC ..... *F25B 5/04* (2013.01); *F25B 6/04* (2013.01); *F25B 39/02* (2013.01); *F25B 40/00* (2013.01); *F25B 41/00* (2013.01); *F25B 49/02* (2013.01); *F25B 5/02* (2013.01); *F25B 2339/047* (2013.01); *F25B 2400/05* (2013.01); *F25B 2400/23* (2013.01); *F25B 2500/19* (2013.01); *F25B 2700/197* (2013.01); *F25B 2700/1933* (2013.01); *F25B 2700/21151* (2013.01); *F25B 2700/21175* (2013.01)

(58) Field of Classification Search

CPC .. F25B 5/04; F25B 39/02; F25B 41/00; F25B 6/04; F25B 40/00; F25B 49/02; F25B 5/02; F25B 2339/047; F25B 2400/05; F25B 2400/23; F25B 2500/19; F25B 2700/1933; F25B 2700/197; F25B 2700/21151; F25B 2700/21175; F25B 40/06

USPC ..... 62/113

See application file for complete search history.

(56) References Cited

U.S. PATENT DOCUMENTS 3,164,973 A * 1/1965 Watkins ..... F25B 41/00 62/503
3,421,339 A * 1/1969 Volk ..... F25B 13/00 62/428
3,664,150 A * 5/1972 Patterson ..... F25B 5/02 62/81

(Continued)

*Primary Examiner* — Eric S Ruppert
*Assistant Examiner* — Kirstin U Oswald
(74) *Attorney, Agent, or Firm* — Whiteford, Taylor & Preston, LLP; Peter J. Davis

(57) ABSTRACT

A system and method for reducing the refrigerant charge in a refrigeration system by preheating the liquid refrigerant before it is introduced to the evaporator inlet. When refrigerant liquid is introduced to the evaporator inlet, a portion of the refrigerant liquid vaporizes. This refrigerant vapor displaces refrigerant liquid at the inlet of the evaporator. As more refrigerant vapor is introduced, the amount of liquid inside the evaporator is reduced. A heat exchanger is placed before the liquid refrigerant inlet of the evaporator to generate more vapor when the refrigerant enters the evaporator.

4 Claims, 3 Drawing Sheets

(56) References Cited

U.S. PATENT DOCUMENTS 3,786,651 A * 1/1974 Eschbaugh ..... F25B 41/335 62/DIG. 17
3,844,131 A * 10/1974 Gianni ..... F25B 45/00 62/149
3,992,895 A * 11/1976 Kramer ..... F25B 47/022 62/155
4,096,706 A * 6/1978 Beckwith ..... F25B 1/00 62/509
4,227,905 A * 10/1980 Burger ..... F25B 30/02 62/505
4,285,208 A * 8/1981 Takeshita ..... F25B 25/02 62/235.1
4,787,213 A * 11/1988 Gras ..... G05D 16/2086 62/212
4,840,042 A * 6/1989 Ikoma ..... F25B 13/00 62/502
5,174,123 A * 12/1992 Erickson ..... F25B 5/04 62/278
5,243,837 A * 9/1993 Radermacher ..... F25B 5/04 62/113
5,245,833 A * 9/1993 Mei ..... F25B 43/006 62/503
5,272,878 A * 12/1993 Schlichtig ..... F25B 9/006 60/649
5,289,699 A * 3/1994 Nivens ..... F28D 7/103 62/113
5,502,970 A * 4/1996 Rajendran ..... F25B 41/35 62/212
5,596,878 A * 1/1997 Hanson ..... B60H 1/00007 62/238.7
5,622,055 A * 4/1997 Mei ..... F25B 43/006 62/503
6,446,446 B1 * 9/2002 Cowans ..... F25B 41/20 62/126
6,901,763 B2 * 6/2005 Memory ..... F25B 43/006 62/503
2005/0120737 A1 * 6/2005 Borror ..... F25B 49/02 62/513
2005/0126190 A1 * 6/2005 Lifson ..... F25B 49/005 62/149
2005/0132731 A1 * 6/2005 Nakamura ..... F25B 9/008 62/160
2005/0235689 A1 * 10/2005 Lifson ..... F25B 49/02 62/513
2005/0247072 A1 * 11/2005 Narayanamurthy .... F25B 41/33 62/434
2006/0230770 A1 * 10/2006 Kitsch ..... F25B 13/00 62/151
2008/0223056 A1 * 9/2008 Heinbokel ..... F25B 9/008 62/225
2010/0083679 A1 * 4/2010 Kolstad ..... F25B 47/025 62/515
2012/0318006 A1 * 12/2012 Liu ..... F25D 21/08 62/190
2013/0000340 A1 * 1/2013 Takayama ..... F25B 9/008 62/222
2014/0033753 A1 * 2/2014 Lu ..... H05K 7/20827 62/190
2016/0047595 A1 * 2/2016 Williams ..... F25D 17/06 62/62

* cited by examiner

EVAPORATOR LIQUID PREHEATER FOR REDUCING REFRIGERANT CHARGE

BACKGROUND OF THE INVENTION

Field of the Invention

The present invention relates to refrigeration systems employing a compressor, condenser and evaporator and more particularly to such systems employing a volatile refrigerant circulated by the compressor; and still more particularly to such systems of the so-called liquid overfeed type of refrigeration system, but the invention may also be used with a direct expansion refrigeration system.

BACKGROUND OF THE INVENTION

The vapor-compression uses a circulating liquid refrigerant as the medium which absorbs and removes heat from the space to be cooled and subsequently rejects that heat elsewhere. All such systems have a compressor, a condenser, an expansion valve (also called a throttle valve or metering device), and an evaporator. Circulating refrigerant enters the compressor in the thermodynamic state known as a saturated vapor and is compressed to a higher pressure, resulting in a higher temperature as well. The hot, compressed vapor is then in the thermodynamic state known as a superheated vapor, and it is at a temperature and pressure at which it can be condensed with either cooling water or cooling air. That hot vapor is routed through a condenser where it is cooled and condensed into a liquid by flowing through a coil or tubes with cool water or cool air flowing across the coil or tubes. This is where the circulating refrigerant rejects heat from the system and the rejected heat is carried away by either the water or the air (whichever may be the case).

The condensed liquid refrigerant, in the thermodynamic state known as a saturated liquid, is next routed through an expansion valve where it undergoes an abrupt reduction in pressure. That pressure reduction results in the adiabatic flash evaporation of a part of the liquid refrigerant. The auto-refrigeration effect of the adiabatic flash evaporation lowers the temperature of the liquid and vapor refrigerant mixture to where it is colder than the temperature of the enclosed space to be refrigerated.

The cold mixture is then routed through the coil or tubes in the evaporator. A fan circulates the warm air in the enclosed space across the coil or tubes carrying the cold refrigerant liquid and vapor mixture. That warm air evaporates the liquid part of the cold refrigerant mixture. At the same time, the circulating air is cooled and thus lowers the temperature of the enclosed space to the desired temperature. The evaporator is where the circulating refrigerant absorbs and removes heat which is subsequently rejected in the condenser and transferred elsewhere by the water or air used in the condenser. To complete the refrigeration cycle, the refrigerant vapor from the evaporator is again a saturated vapor and is routed back into the compressor.

SUMMARY OF THE INVENTION

The invention is a system and method for reducing the refrigerant charge in a refrigeration system, specifically by reducing the required refrigerant charge in the evaporator by preheating the liquid refrigerant before it is introduced to the evaporator inlet. When refrigerant liquid is introduced to the evaporator inlet, a portion of the refrigerant liquid vaporizes. This refrigerant vapor displaces refrigerant liquid at the inlet of the evaporator. As more refrigerant vapor is introduced, the amount of liquid inside the evaporator is reduced. According to the present invention, a heat exchanger placed before the liquid refrigerant inlet of the evaporator. This heat exchanger is used to pre-heat the liquid to generate more vapor when the refrigerant enters the evaporator. The increased amount of vapor entering the evaporator (relative to prior art systems), displaces the liquid refrigerant, thus reducing the refrigerant charge required for the evaporator, and thus, for the overall system. According to one embodiment, the liquid refrigerant may be heated in order to fully vaporize 5%-30% of the refrigerant. According to related embodiments, the liquid refrigerant may be heated in order to full vaporize 10%-30% of the refrigerant, 15%-30% of the refrigerant, 20%-30% of the refrigerant, 5%-10% of the refrigerant, 5%-15% of the refrigerant, or 10%-20% of the refrigerant.

According to another embodiment, the liquid refrigerant may be heated to a temperature that is between 10% and 80% of the difference between the operating temperatures of the condenser and the evaporator. For example, if the condenser is operating at 90° F. and the evaporator is operating at 30° F., the temperature difference is 60° F., and the liquid refrigerant may be warmed to 36° F. (10% of the temperature difference) or to 78° F. (80% of the difference, or anywhere in between 36° F. and 78° F. According to related embodiments, the liquid refrigerant may be heated to a temperature that is 20%, 30%, 40%, 50%, 60% or 70% of the difference between the operating temperature of the condenser and the evaporator.

The heat exchanger heat source can be an external energy input such as waste heat produced by a refrigeration compressor, or an internal heat source such as the warm refrigerant liquid that exits from the condenser in the refrigeration system. By using warm liquid from the condenser, the net energy required to produce cooling is not increased. This arrangement is preferred when the liquid refrigerant flow to the evaporator is of the liquid overfeed type where a portion of the introduced refrigerant liquid exits the evaporator in a liquid state.

Any type of heat exchanger that can increase the temperature of a refrigerant liquid can be used. A liquid to liquid heat exchanger is preferred especially for a liquid overfeed evaporator. Fusion bonded plate heat exchangers such as manufactured by Alfa Laval are especially suited for this purpose.

DETAILED DESCRIPTION

Figure 1:
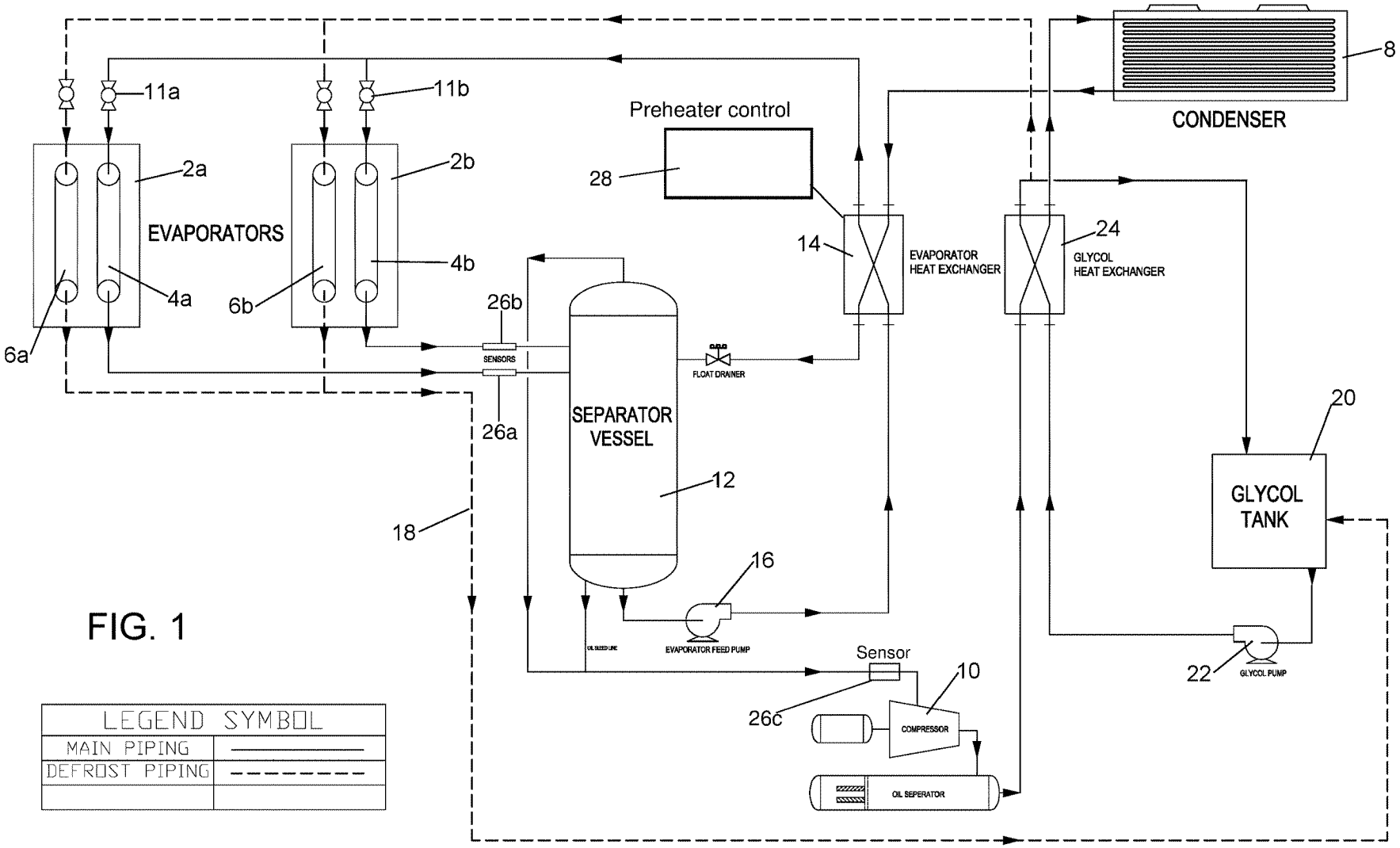
FIG. 1 is a schematic of a refrigeration system according to an embodiment of the invention.
Figure 2:
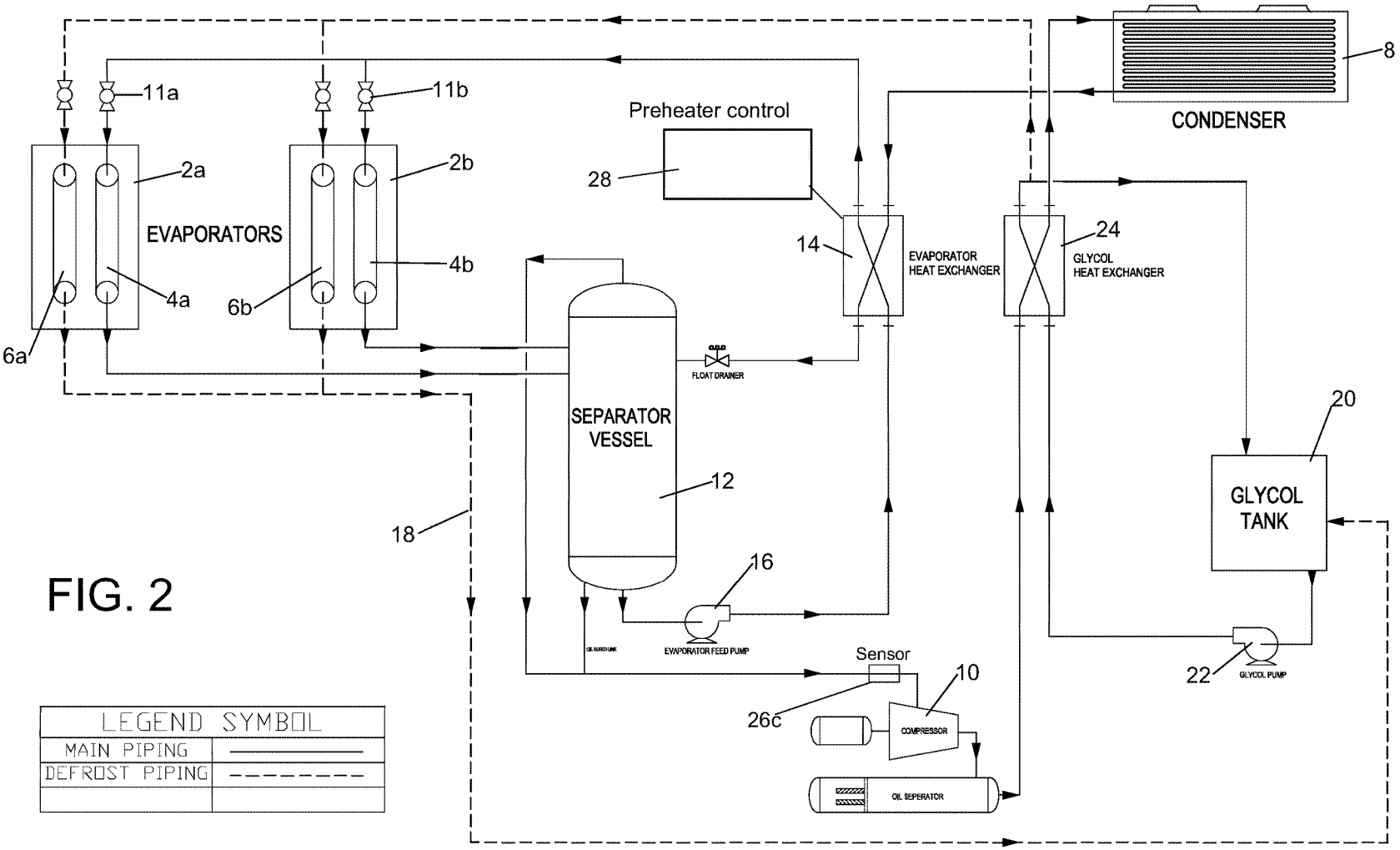
FIG. 2 is a schematic of a refrigeration system according to a second embodiment of the invention.
Figure 3:
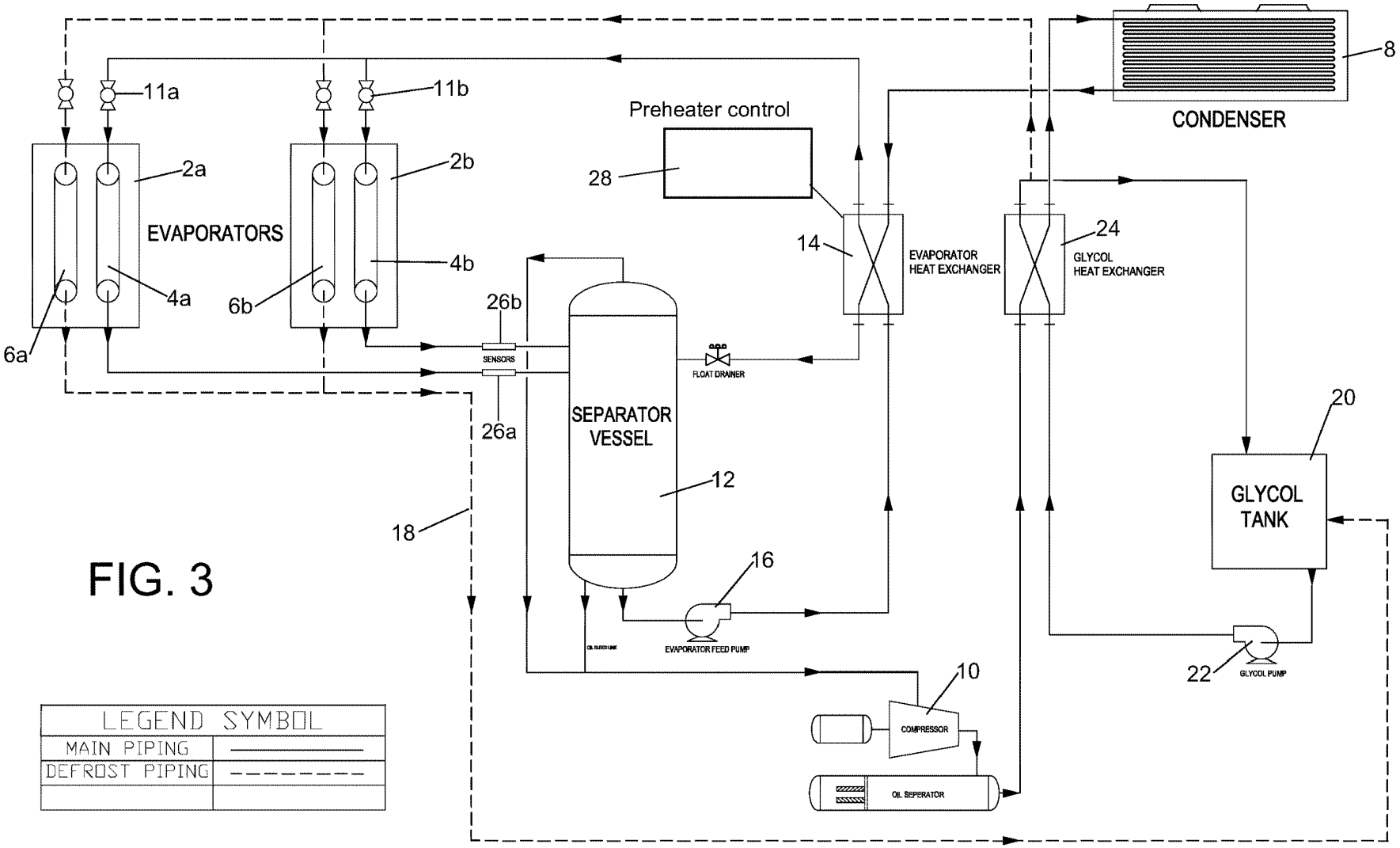
FIG. 3 is a schematic of a refrigeration system according to a third embodiment of the invention.

FIG. 1 shows a piping schematic showing an evaporator heat exchanger according to an embodiment of the invention in relation to other components in a liquid overfeed system. This is a preferred piping arrangement to maximize refrigeration system efficiency. The system includes evaporators 2*a* and 2*b*, including evaporator coils 4*a* and 4*b*, respectively, and defrost/glycol coils 6*a* and 6*b*, respectively, condenser 8, compressor 10, expansion devices 11*a* and 11*b* (which may be valves, metering orifices or other expansion devices), and separator vessel 12. The foregoing elements may be connected using standard refrigerant tubing in the manner shown in FIG. 1, or according to any standard arrangement. Defrost system 18 includes glycol tank 20, glycol pump 22, glycol heat exchanger 24 and glycol coils 6*a* and 6*b*, also connected to one-another and the other element of the system using refrigerant tubing according to the arrangement shown in FIG. 1, or according to any standard arrangement. According to the invention, evaporator pre-heater heat exchanger 14 is located before (upstream of) the inlet to the evaporators 2*a* and 2*b* to preheat the liquid refrigerant prior to introduction to the evaporator inlet. The energy required to preheat the liquid refrigerant may be provided by a source internal to the system, such as heated refrigerant leaving the condenser 8, as shown in FIG. 1. An evaporator feed pump 16 may also be provided to provide the additional energy necessary to force the refrigerant through the evaporator heat exchanger. According to one embodiment, the evaporator feed pump may be selected and configured to increase the pressure of the liquid refrigerant to 100 psi or greater in order to prevent an excess amount of refrigerant from vaporizing upon pre-heating.

By increasing the temperature of the liquid refrigerant at the evaporator inlet, more vapor is produced as the refrigerant enters the evaporator, thus reducing the required refrigerant charge per ton of refrigeration capacity. According to preferred embodiments, pre-heating the refrigerant prior to introduction of the refrigerant to the evaporator inlet will reduce the refrigerant charge per ton of refrigeration capacity by 10% and as much as 50%, relative to an identical system that does not include a refrigerant pre-heater. Other embodiments can reduce the refrigerant charge per ton of refrigeration capacity by 20%, by 30%, or by 40%.

Sensors 26*a* and 26*b* may be located downstream of said evaporators 2*a* and 2*b*, upstream of the inlet to the separator 12, to measure the temperature, pressure, and/or vapor/liquid ratio of refrigerant leaving the evaporators. According to alternative embodiments, sensor 26*c* may be located in the refrigerant line between the outlet of the separator 12 and the inlet to the compressor 10. Sensors 26*a*, 26*b* and 26*c* may be capacitance sensors of the type disclosed in U.S. Ser. Nos. 14/221,694 and 14/705,781, the disclosures of which are incorporated herein by reference, in their entirety. According to an embodiment of the invention, the evaporator pre-heater 14 may be controlled by a control system 28 that can be used to manually or automatically control the mount of pre-heat that is provided to the refrigerant flowing through the pre-heater. According to a preferred embodiment, control system 28 may be configured to control the amount of pre-heat applied to the refrigerant passing to the evaporator based on data, including refrigerant temperature, pressure and/or liquid/vapor ratio, received from said sensors 26*a*, 26*b*, and/or 26*c*.

The invention claimed is:

1. A method for reducing the refrigerant charge in a liquid overfeed refrigeration system comprising preheating liquid refrigerant prior to introduction of the liquid refrigerant to an evaporator of said refrigeration system to vaporize a portion of said liquid refrigerant to refrigerant vapor and introducing a mixture of said liquid refrigerant and said refrigerant vapor to said evaporator, said method further comprising measuring a property of said refrigerant at an outlet of said evaporator and adjusting an amount of said preheating based on said measured property;

wherein said preheating liquid refrigerant step comprises adjusting an amount of heat that is applied to said liquid refrigerant based on data from a sensor located between an outlet of the refrigerant evaporator and an inlet of a compressor, said sensor measuring at least one of temperature, pressure and liquid vapor ratio of refrigerant leaving the refrigerant evaporator;

wherein said preheating liquid refrigerant step is carried out in an indirect heat exchanger located in a refrigerant flow path between an evaporator feed pump and an evaporator inlet, in which warmed refrigerant liquid from a refrigerant condenser is used to provide heat to refrigerant leaving said evaporator feed pump.

2. The method according to claim 1, comprising heating said liquid refrigerant to convert 10% to 30% of said liquid refrigerant to said refrigerant vapor and delivering said refrigerant vapor to said evaporator with a remainder of said liquid refrigerant.

3. The method according to claim 1, said refrigeration system comprising a refrigerant evaporator, a refrigerant compressor, a refrigerant condenser, an expansion device and a refrigerant pre-heater connected in a refrigerant flow path in the refrigerant system in the following order: (a) compressor-(b) condenser-(c) pre-heater-(d) expansion device-(e) evaporator-(a) compressor.

4. The method according to claim 3, said refrigerant flow path further comprising a separator element configured to separate liquid and vapor refrigerant leaving said evaporator.

* * * * *